US005751248A

United States Patent [19]

Thaniyavarn

[11] Patent Number: 5,751,248

[45] Date of Patent: May 12, 1998

[54] PHASED ARRAY BEAM CONTROLLER USING INTEGRATED ELECTRO-OPTIC CIRCUITS

[75] Inventor: Suwat Thaniyavarn, Bellevue, Wash.

[73] Assignee: The Boeing Company, Seattle, Wash.

[21] Appl. No.: 655,333

[22] Filed: May 24, 1996

Related U.S. Application Data

[63] Continuation-in-part of Ser. No. 322,897, Oct. 13, 1994, Pat. No. 5,543,805.

[51] Int. Cl.[6] ..... H01Q 3/22

[52] U.S. Cl. ..... 342/368

[58] Field of Search ..... 342/368, 372

[56] References Cited

U.S. PATENT DOCUMENTS

| | | | |
|---|---|---|---|
| 3,331,651 | 7/1967 | Sterzer . | |
| 3,964,819 | 6/1976 | Auracher . | |
| 4,360,921 | 11/1982 | Scifres et al. . | |
| 4,396,246 | 8/1983 | Holman . | |
| 4,607,916 | 8/1986 | Sanford et al. . | |
| 4,739,334 | 4/1988 | Soref . | |
| 4,764,738 | 8/1988 | Fried . | |
| 4,767,170 | 8/1988 | Muzutani et al. . | |
| 4,814,773 | 3/1989 | Weschberg et al. . | |
| 4,856,094 | 8/1989 | Heidrich et al. . | |
| 4,878,724 | 11/1989 | Thaniyavarn . | |
| 4,885,589 | 12/1989 | Edward et al. . | |
| 5,111,517 | 5/1992 | Riviere . | |
| 5,333,000 | 7/1994 | Hietala et al. | 342/368 |
| 5,367,305 | 11/1994 | Volker et al. | 342/368 |
| 5,543,805 | 8/1996 | Thaniyavarn | 342/368 |

FOREIGN PATENT DOCUMENTS

| | | | |
|---|---|---|---|
| 3-36529 | 2/1991 | Japan | 385/14 |

OTHER PUBLICATIONS

V. Ramaswamy, M.D. Divino, R.D. Standley, Balanced Bridge Modular Switch Using Ti–diffused $LiNbO_3$ Strip Waveguides, Appl. Phys. Lett. 32(10), 15 May 1978.

*Primary Examiner*—Gregory C. Issing
*Attorney, Agent, or Firm*—Mary Y. Redman

[57] ABSTRACT

A photonic device for controlling phased array beam direction includes an electro-optic substrate; a plurality of waveguides formed in the substrate, each of which is capable of simultaneously propagating light signals with orthogonal polarizations; an input waveguide for inputting into each one of the plurality of waveguides a pair of copropagating polarized light signals having orthogonal polarizations and different frequencies; a plurality of electrodes on the substrate configured to phase shift the signals traveling through each waveguide by a different amount in response to applied voltages, thereby creating phase shifted polarized signals; and means for combining the phase shifted polarized signals within each one of the waveguides and propagating these combined signal to an antenna element. The basic operating principle of the invention is based on the differential phase shift between optical waves of orthogonal polarizations traveling in an electro-optic optical waveguide. This differential phase shift is directly proportional to the voltage applied to a control electrode and to the length of that electrode. If the two optical waves are slightly offset in optical frequency, they produce a beat frequency when photodetected whose phase shift equals the optical differential phase shift. An array of such phase shifters forms the basis for the photonic beam controller of the invention.

23 Claims, 3 Drawing Sheets

PHASED ARRAY BEAM CONTROLLER USING INTEGRATED ELECTRO-OPTIC CIRCUITS

CROSS-REFERENCES TO RELATED APPLICATIONS

This application is a continuation-in-part of prior application Ser. No. 08/322,897, filed Oct. 13, 1994 now U.S. Pat. No. 5,543,805.

FIELD OF THE INVENTION

This invention relates to beam steering for phased array antennas, and to integrated electro-optic circuits.

BACKGROUND OF THE INVENTION

Advanced microwave phased array antenna systems will play an increasingly important role in communications and surveillance. The signal generation, control, transmission, distribution and signal processing at these high frequencies pose challenging problems, particularly when the number of antenna elements is large, the controller is remotely located from the antenna, the signal frequency extends to the millimeter wave range, or a larger signal bandwidth is required.

Phased array systems require fast, accurate control of the phases and amplitudes of multiple antenna elements for beam forming and steering. However, electronic techniques for controlling the phase of individual elements of the phased array require complex signal distribution and control networks to link up and control each individual antenna element using microwave electronic circuits at each antenna element which are relatively bandwidth limited.

FIG. 1 is a schematic diagram of a typical phased array antenna with prior art electronic beam steering circuits. Each antenna element 2 has associated with it an electronics module 3 which includes a microwave phase shifter 4. Since a typical phased array can have as many as 1000 antenna elements, this necessitates as many as 1000 individual phase shifters. The typical microwave phase shifter 4 at each antenna element 2 is based on a stepped microwave delay-line circuit. This circuit consists of several electronic switches and interconnecting microwave transmission lines. Several control signals (one for each bit) are required to set all the switches for each antenna element. This phase shifting scheme results in limited phase resolution, high loss, limited bandwidth and a complex controlling network. In a phased array antenna having on the order of 1000 antenna elements, each requiring several lines 5 to carry control signals, the complexity of the required controlling network will be apparent. In addition to this complexity, conventional transmission feeds using precision microwave guides and coaxial cables are increasingly less attractive due to large size, weight, and excessive transmission loss. Also, inadequate bandwidth capability and susceptibility to electromagnetic interference seriously limit the performance of such systems. And, only one beam from the array can be controlled at any one time.

SUMMARY OF THE INVENTION

The invention is a photonic device for controlling phased array beam direction using optical heterodyning techniques, polarization mixing, and integrated optical circuits to perform high-speed, continuous beam steering of a phased array antenna. In a preferred embodiment, it includes an electro-optic substrate; a plurality of waveguides formed in the substrate, each of which is capable of simultaneously propagating light signals with orthogonal polarizations; an input waveguide for inputting into each one of the plurality of waveguides a pair of co-propagating polarized light signals having orthogonal polarizations and offset frequencies; a plurality of electrodes on the substrate configured to differentially phase shift the signals on each polarization traveling through each waveguide by a different amount in response to control voltages applied to the electrodes, thereby creating a differential phase shift between the two polarized signals; and means for combining the phase shifted polarized signals within each one of the waveguides. Each of these combined signals are then propagated to an antenna element. The electrodes can be configured to respond to a common applied voltage, or to separate control voltages, if desired.

With the invention, photonics technology can be used to control both phase and amplitude of the microwave radiation in the optical domain to achieve compact, broadband operation. The basic operating principle of the invention is based on the differential phase shift between optical waves of orthogonal polarizations traveling in an electro-optic optical waveguide. This differential phase shift is directly proportional to the voltage applied to a control electrode and to the length of that electrode. The outputs from the waveguide are passed through a polarizer having its polarizing axis oriented at an angle (such as 45 degrees) to the orthogonal polarizations, so as to effectively combine components from each signal. The optical signals at different frequencies are, in effect, coherently combined and detected by an array of high speed optical detectors, thereby generating a set of microwave outputs. These heterodyne beat signals have a beat frequency when photodetected equal to the difference in the optical laser frequencies and phase equal to the optical differential phase shift. An array of such phase shifters in a single integrated electro-optic circuit forms the basis for the photonic beam controller of the invention.

This invention exploits the most fundamental benefit of photonics, which accrues from its transmission medium: optical fiber. Optical fiber offers low loss, low dispersion, small size, low weight, and EMI immunity. These properties allow the separation of array functions in ways that previously were impossible. Using the invention, all of the individual electronic phase-shifter circuits located at each antenna element of a typical prior art system can be replaced by a single photonic phase shifter circuit integrated on a single substrate. This photonic circuit can be remotely located and connected to the antenna elements through fiber optics. Thus, control functions can be moved off the array and processing can be located wherever convenient. With the present invention, difficulties in packaging the ultra-small modules of phased arrays, particularly at higher and higher frequencies such as EHF, can be alleviated by moving phase and amplitude functions to a central location. The resulting electronics modules can be simpler, cheaper, and higher in yield. The myriad control signals that previously ran to and through the aperture can now be confined to a compact, integrated controller as provided by the invention, remote from the array. This creates heretofore unknown possibilities such as, for example, the simultaneous control of two beams at different frequencies, by using two controllers in parallel.

Because the phase shifting accomplished by the present invention is linear and continuous with applied voltage, high speed, high resolution phase adjustment is possible. This is an important advantage over electronic phase shifters which provide only discrete phase shifting resolution due to their use of discrete switching between different delay line paths.

Furthermore, unlike microwave electronic phase shifters which are typically narrow-band, the phase shifters of the invention is frequency independent and can be used as a common phase-shifter for any microwave frequency from dc to beyond 100 GHz. And, unlike electronic phase shifters, the integrated electro-optic phase shifter of the invention can introduce any phase shift amount without any associated amplitude variation.

In one embodiment of the present invention, phase shifting for an entire phased array can be controlled with a single voltage, if desired, rather than with the thousands of control signals needed for a phased array with individual electronic phase shifters at each antenna element. Thus, the computer needed with a prior art system to compute the many control signals needed to, for example, track a moving target, is unnecessary and can be replaced by a simple analog feedback circuit. In another embodiment, separate independent control voltages can be sent to the electrodes, while still taking advantage of the benefits of optical fiber and photonic technology.

DETAILED DESCRIPTION OF THE DRAWINGS

For clarity of understanding, the concept underlying the claimed invention will first be explained in reference to a single channel phase shifter, and then to phase shifters for linear and two dimensional antenna arrays.

Figure 1:
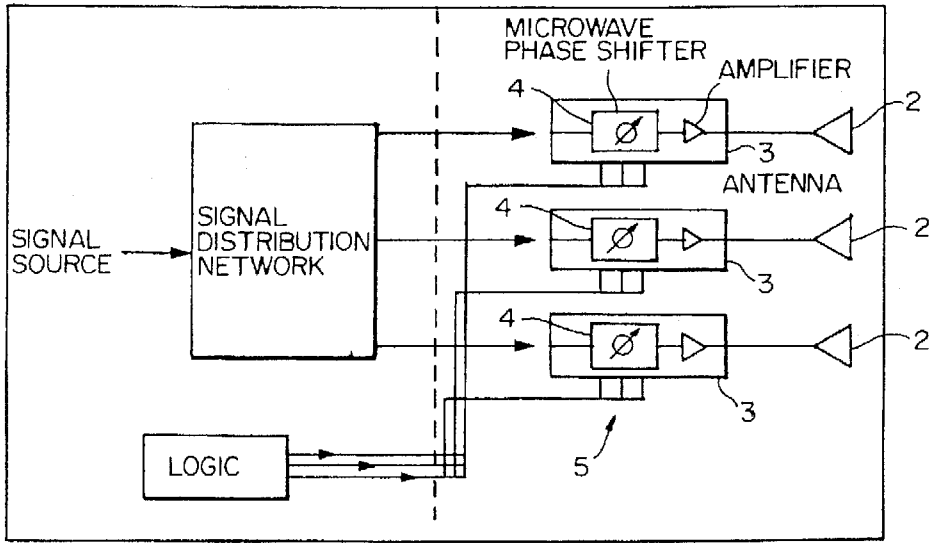
FIG. 1 PRIOR ART
FIG. 1 is a schematic diagram of a phased array antenna with prior art phase shifters.
Figure 2:
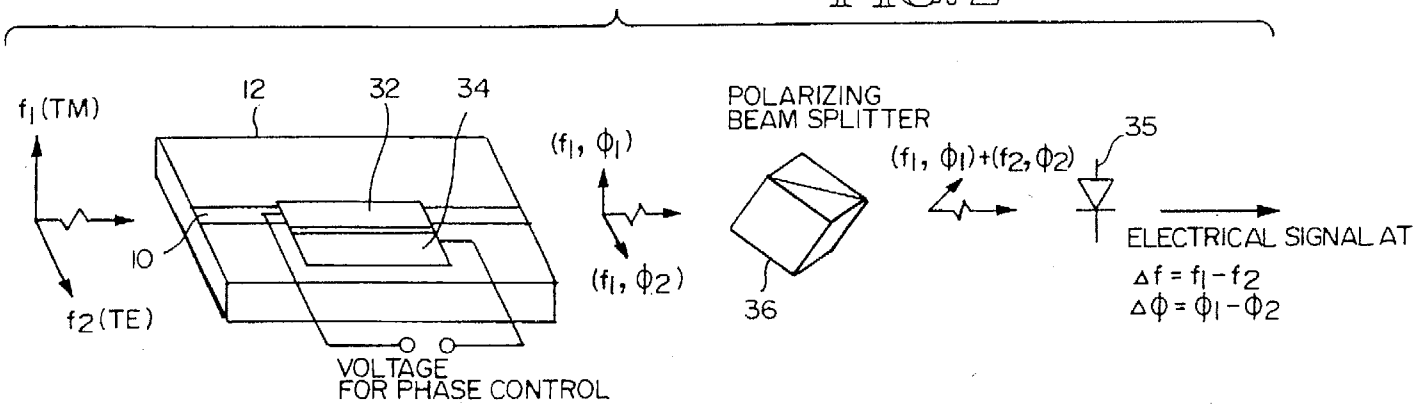
FIG. 2 is a schematic diagram showing the basic operating principle of the claims invention.

Referring to FIG. 2, signals from two phase locked optical sources at frequencies $f_1$ and $f_2$ are launched into an optical waveguide 10 in a substrate 12 as orthogonal TE and TM waves. In the illustrated embodiment, this technique employs a pair of single-frequency lasers, such as Nd: YAG lasers, that are phase locked with a frequency offset. Frequency offset is controlled using standard phase-lock loop circuitry well-known in the art. Lasers that can easily generate a difference frequency from near DC to greater than 100 GHz. are commercially available with over 100 mW of CW output power coupled into an optical fiber. This permits reasonable signal levels after losses due to coupling, splitting, and distribution to multiple phased-array elements are taken into account. Any of a variety of optical sources can be used, such as for example, phase-locked diode-pumped solid-state (DPSS) lasers or semiconductor lasers. The particular optical sources used in the invention can be chosen according to the requirements desired for a particular application taking into account such factors as, for example, cost, tunability, size, acceptable noise levels, line width, etc.

One advantage of using DPSS laser is that the free-running linewidth is approximately 5 kHz. This is much narrower than the typical 10 MHz linewidth of semiconductor lasers. DPSS lasers can thus be phase locked with relatively simple electronic circuitry. These lasers are commonly furnished with a piezoelectric transducer (PZT) incorporated into the laser cavity by the manufacturer for frequency tuning and phase-locking applications. An applied voltage causes an incremental change is the cavity length, which shifts the laser oscillation frequency. The transfer function closely approximates that of an ideal voltage-controlled oscillator.

Still referring to FIG. 2, the TE and TM waves which have been launched into the waveguide 10 are differentially phase shifted (i.e., the signal with one polarization is phase shifted by a different amount than the signal with the other polarization) by applying a DC voltage to the electrodes 32, 34 straddling the waveguide 10. The magnitude of the differential phase shift $\Delta\phi$ is proportional to the amplitude of the applied voltage, the length of the electrodes, and the difference in the electro-optic coefficients of the waveguide for the two polarization states. At the output of the optical waveguide 10, a polarizer 36 such as, for example, a polarizing beam splitter, with its polarization axis oriented at an angle with respect to the two polarization states of the signals, sums the components of the two optical beams in that polarization axis. For most applications, where the two signals at frequencies $f_1$ and $f_2$ are originally of about equal strength, a polarizer having its polarization axis at 45 degrees to the two orthogonal polarization states will give good results. But, the exact angle of this polarization axis is not crucial and can be chosen as desired for a particular application, as long as the output from the polarizer includes components from both of the polarized signals. The light output from the polarizer 36 is sent through optical fiber to a photodiode 38 in a phased-array antenna module. The detector output is a microwave beat signal having a frequency $\Delta f=f_2-f_1$, and a signal phase shift $\Delta\phi$ that is identical to the differential optical phase shift, yet independent of signal frequency.

A highly preferred material for the substrate 12 on which the integrated electro-optic circuit is fabricated is lithium niobate ($LiNbO_3$). High-quality waveguides can be easily formed in this material by titanium diffusion. $LiNbO_3$ has several other important attributes for this applications. Its large electro-optic coefficient allows for very efficient phase shifting over a full $2\pi$ range with low applied voltage (less than 10 V). Substrates in sizes that allow complex, multi-stage optical circuits to be fabricated monolithically are readily available.

Figure 3:
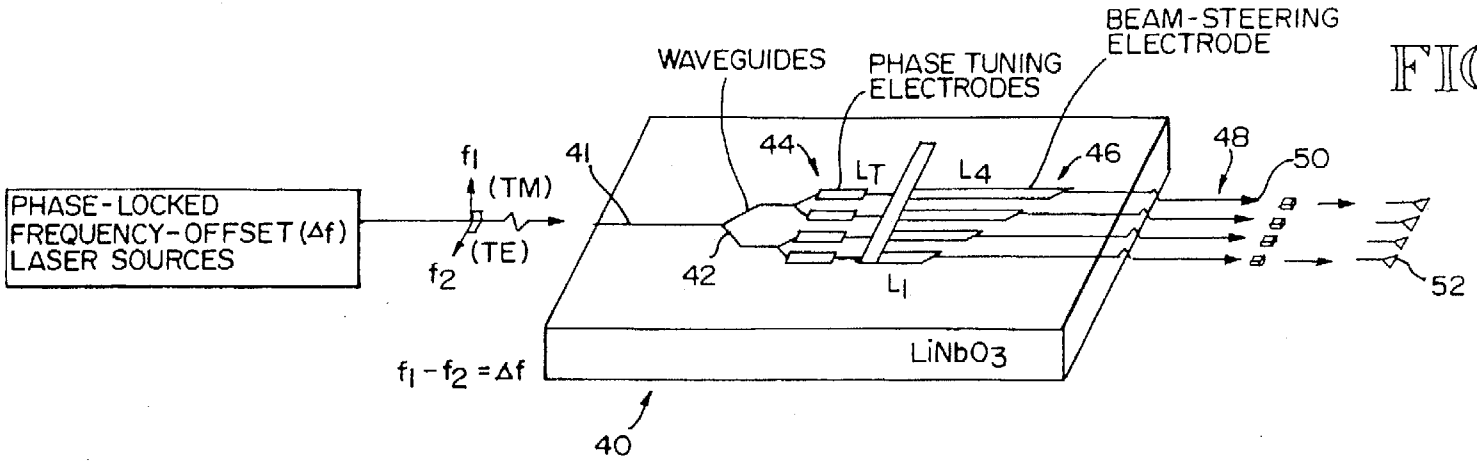
FIG. 3 is a schematic diagram of an preferred embodiment of the invention adapted for beam steering a linear antenna array.

With reference now to FIG. 3, the basic phase shifting technique discussed above can be used to form a multi-channel integrated electro-optic phase control circuit for steering a linear array. A 4-channel version of such a module is illustrated in FIG. 3. Although four channels are shown for purposes of illustration, it will be readily understood that any desired number of channels can be provided. The first section of the circuit 40 contains an input waveguide 41 which propagates the incoming signals in the TE and TM modes to waveguides forming a 1×4 beam divider 42 to split the input optical beams among the four phase-shift channels. A first electrode stage 44 has four separate electrodes, one for each channel, that provide for individually adjusting or tuning the initial phase state for each channel to be at a desired value, such as, for example, the same for all channels. This tuning electrode stage 44 could be placed before or after the phase shift electrodes, or omitted, as desired. The second electrode stage 46 has four electrodes that are, in the illustrated embodiment, connected to a common control voltage. The differential phase for any channel i is $\Delta\phi_i$ and is proportional to the electrode length $L_i$ and the applied voltage V. In the illustrated embodiment, a linear taper of the electrode lengths is used so that application of a single control voltage produces a differential phase shift that varies linearly between channels. Different electrode geometries could be chosen for different, non linear effects. Or electrodes of equal length could be used with a separate control voltage being applied to each in a substantially simultaneous manner.

In the illustrated embodiment, polarizing optical fiber 48 is used as a polarizer, although it will be understood that in this and all other embodiments, a polarizing beam splitter or other polarizing element could likewise be used. The optical outputs from the four channels are conveyed by polarizing optical fiber 48 to four high-speed photodiodes 50. The polarizing fiber 48 has its polarization axis at an angle such as 45 degrees to the input polarization states to effectively force the two original signals at orthogonal polarizations to mix at the detectors 50. Coherent detection in these photodiodes 50 produces a microwave beat signal that is amplified and radiated by the antenna elements 52. Any phase shift in the optical domain maps one-for-one into the microwave domain. This means that the microwave beat frequency in the various channels have the same linear phase shift between them as is imposed on the optical carriers. The phase gradient between the channels determines the pointing direction of the radiated beam. By varying the single control voltage applied to the second electrode stage 46 in the preferred embodiment, the output from the phased array beam can be continuously steered in one dimension. However, separate control voltages for each electrode pair could also be used.

The polarizing fibers 48 sum the frequency-offset laser beams which exit the second electrode stage 46 in a common polarization state (such as 45 degrees to the orthogonal polarizations of the beams). An important feature of the illustrated embodiment is that as they travel through the beam-control substrate 40, the orthogonal laser beams share a short, common optical path. After exiting this substrate and traveling through the polarizing fibers 48, the beams have the same polarization state and the signals for each channel travel through a common fiber. Temperature fluctuations or vibrations thus have negligible effect on the beat signal stability.

Figure 4:
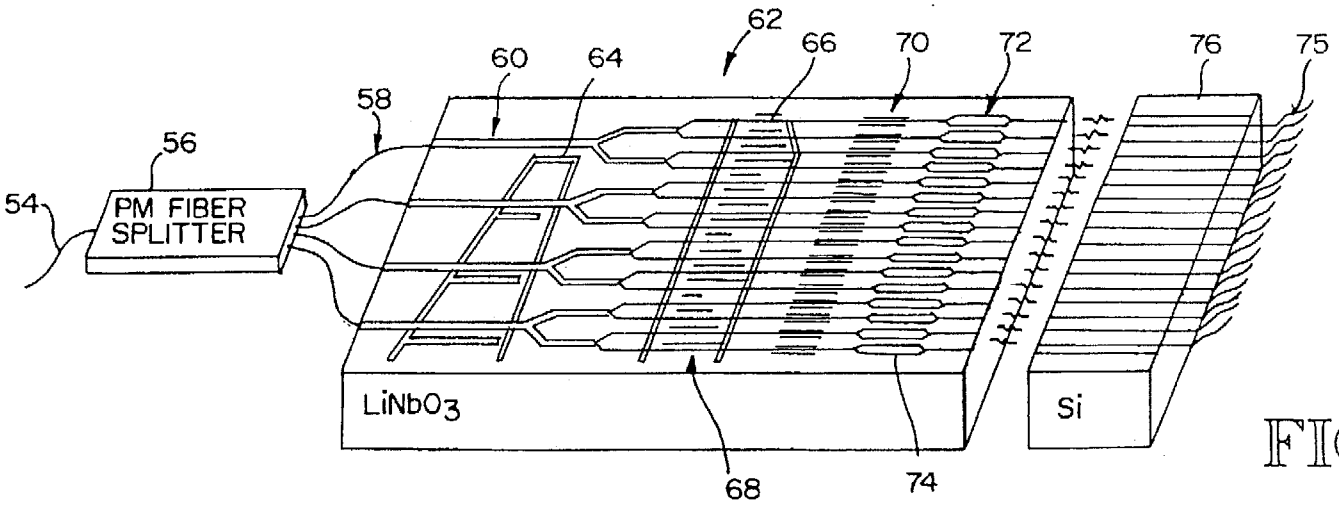
FIG. 4 is a schematic diagram of an embodiment of the invention adapted for beam steering a two dimensional antenna array.

FIG. 4 shows an embodiment of the invention adapted for controlling the two-axis positioning of a beam from a two-dimensional phased array. For illustrative purposes, a circuit suitable for control of a 4×4 square array with sixteen antenna elements is shown. However, it will be readily apparent the same basic beam control strategy can be adapted for other geometries and sizes. In this illustrated embodiment, the frequency-offset TE and TM modes are launched into a single-mode, polarization-maintaining fiber 54. These co-propagating beams are split by a fiber coupler among four fibers 55 that are coupled to the four input channel waveguides 60 of the monolithic integrated electro-optic control circuit 62. Astride these four waveguides are four electrodes 64 with a linear length taper that phase shifts signals in response to a commonly applied control voltage, produces elevation beam steering in concert among all the antenna columns (it will be understood that reference to rows and columns are interchangeable and not intended to limit the invention to a particular orientation). This stage is followed by a 1×4 split of each input channel, resulting in sixteen channels in four sets of four. Astride these sixteen channels 66 are four identical sets of four electrodes with a linear length taper within each set. A single control voltage is sent to all sixteen electrodes. These electrodes 68 produce beam steering in azimuth among the array rows. For an N×M array, the circuit would preferably have N input waveguide channels that are then split into (N×M) waveguides, in N sets of M channels. The orthogonality of the beam steering axes permits the effective addition of cumulative differential phase shifts. Thus, controlling only two voltages produces the desired two-dimensional beam steering.

Figure 5:
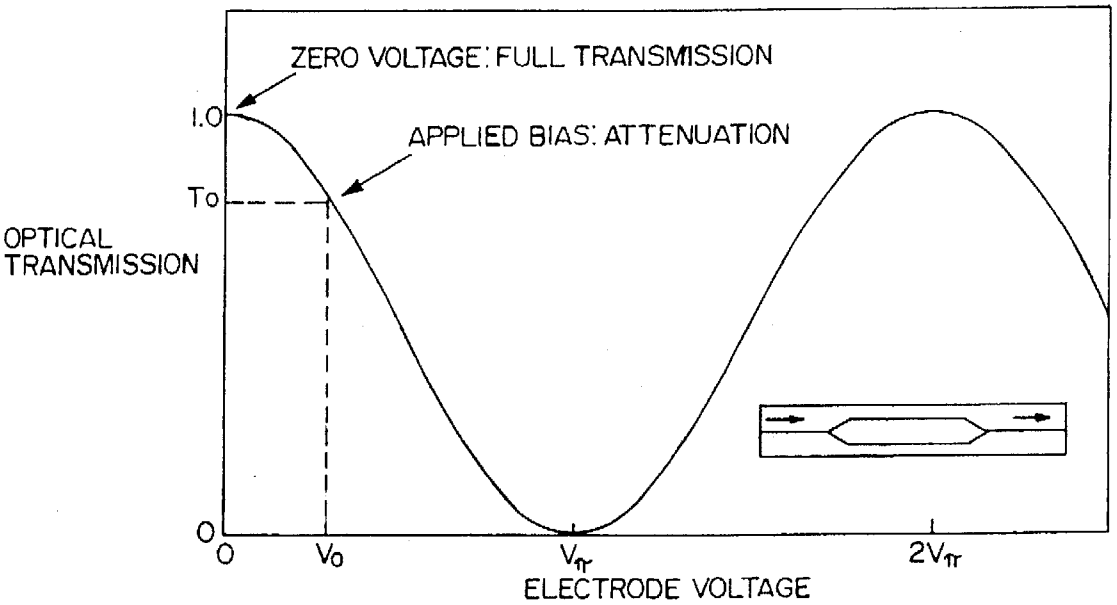
FIG. 5 shows the transfer function of a Mach-Zender interferometer, used as an attenuator.

Final phase bias electrodes 70 remove any channel-to-channel phase errors or apply any non-linear phase shifts that may be desired with, individual electrodes controlling the phase of each channel. The resulting sixteen calibrated outputs of the illustrated embodiment then pass to an array 72 of sixteen attenuators 74 which adjust the amplitudes of the signals passing through. Each of these attenuators can be a Mach-Zender interferometer. To illustrate how these operate as attenuators, FIG. 5 plots the transfer function for a Mach-Zender integrated optical interferometer. An applied voltage shifts the phase of the optical signal in one of the two arms of the interferometer. At an applied voltage $V_o$, the optical output drops to $T_o$. While such devices are commonly used to apply high-frequency signals on light beams, here the applied voltage is near DC and serves only to adjust the optical output for apodization. The attenuators make adjustments to apodize the phased array antenna aperture for sidelobe suppression, if desired, and to compensate for signal imbalances caused by optical loss, electrode efficiency, or electronic gain variations.

In the illustrated embodiment, after phase and amplitude adjustments, the two polarizations will be mixed in polarizing fibers 75 with their polarization axes placed at 45 degrees with respect to both input polarizations. A silicon substrate 76 with V grooves properly aligned and oriented to the end face of the fibers couples the signals into the fibers. The sixteen output fibers carry the frequency-offset, phase-shifted optical beams to the photodiodes that preferably are located at the antenna array. Because the two optical beams in a channel co-propagate through the entire optical path from the first 1×4 split onward to the photodiodes, any environmental factors introducing spurious, or time-varying, phase-shifts in a channel affect both optical signals the same. Therefore, the differential phase-shift remains as set by the control voltages independent of environmental effects.

Because the beam controller of the preferred embodiment provides phase shift, not time delay, it will correctly steer a single, narrowband beam. A variable time delay device can be combined with the invention to provide broadband steering of the single beam. An example of a suitable variable time delay device is shown in U.S. Pat. No. 5,455,878, which is incorporated herein by reference.

Because the invention removes the phase-shift function from the antenna modules, it makes possible an operating mode not otherwise possible in phased array operation: simultaneous formation of independent beams at different frequencies. Practical considerations dictate that electronic microwave phase shifters be located in the antenna modules. This limits their action to only a single signal at a time. Optical-domain phase shifting with the present invention allows two or more phase shifters to operate in parallel outside the antenna modules on signals of different frequency. These signals can then be optically combined prior to delivery to the antenna. This approach avoids phase shift anomalies that would otherwise result from attempting to set the phase at two frequencies with a single device.

Figure 6:
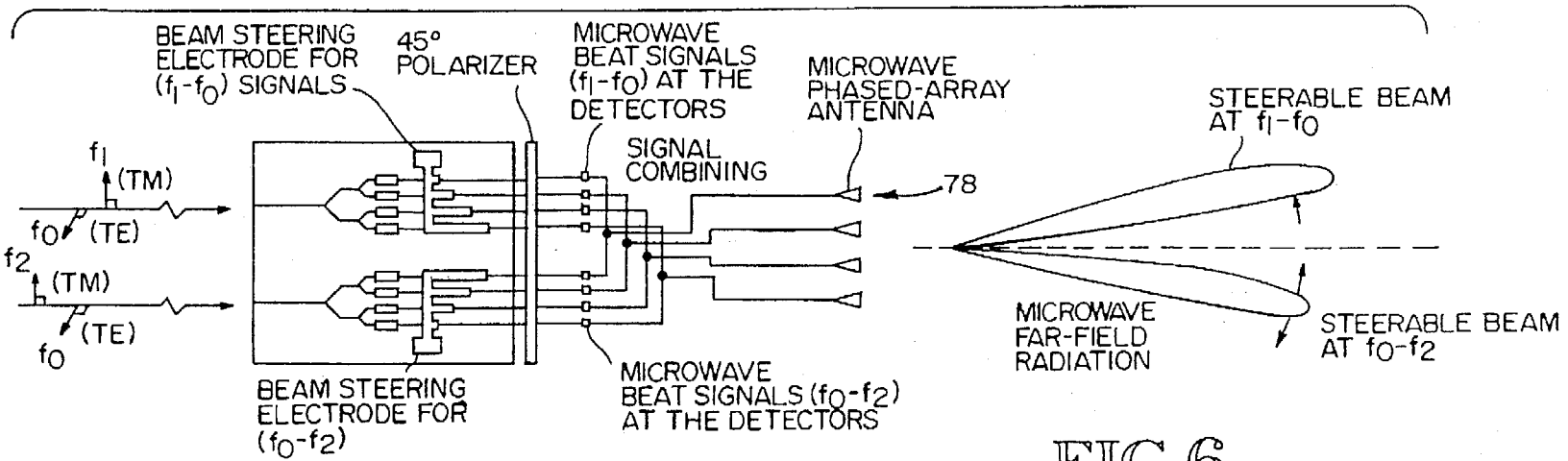
FIG. 6 is a schematic diagram showing an embodiment of the invention for independently steering multiple beams from a phased antenna array.

FIG. 6 shows an example of an architecture for controlling two transmit frequencies for a single array 78. This architecture could utilize, for example, two lasers operating in parallel phase lock loops which share a common reference laser, or any other arrangement which results in two pairs of mutually orthogonal optical signals. The pairs of orthogonally polarized light signals are input into two integrated optic phase shift circuits 87, 88 constructed as described above, which operate independently in parallel. These two phase shift circuits 87, 88 can be fabricated on a single substrate. Outputs from each phase shift circuit are transmitted to high-speed photodetectors. A pair of microwave beat signals, one originating from each beam controller circuit, is transmitted to each antenna element.

Although the invention has been described above with respect to certain specific embodiments, the scope of the invention is not limited to the specific embodiments disclosed. Other designs within the spirit and scope of the invention will be apparent to those skilled in the field after receiving the above teachings. The scope of the invention, therefore, is defined by reference to the following claims.

What is claimed is:

1. An apparatus for controlling a phased array antenna which includes a plurality of antenna elements, comprising:

an electro-optic substrate;

a plurality of waveguides formed in said substrate, each of said waveguides being capable of simultaneously propagating light signals with orthogonal polarizations;

an input waveguide for inputting into each one of said plurality of waveguides a pair of co-propagating polarized light signals having orthogonal polarizations and offset frequencies;

a plurality of electrodes on said substrate configured to phase shift the signals traveling through each of said plurality of waveguides by a different amount in response to applied voltages, thereby creating phase shifted polarized signals; and means for combining the phase shifted polarized signals within each one of said plurality of waveguides and propagating said combined signal to one of said plurality of antenna elements.

2. The apparatus of claim 1 wherein said applied voltages include a plurality of voltages each of which is applied to one of said plurality of electrodes substantially simultaneously.

3. The apparatus of claim 2 wherein said plurality of electrodes includes a series of electrodes straddling said plurality of waveguides and having equal lengths.

4. The apparatus of claim 1 wherein the combining means includes polarizing optical fiber.

5. The apparatus of claim 1 wherein said applied voltages include a voltage applied in common to each of said plurality of electrodes, and said plurality of electrodes includes a series of electrodes straddling said plurality of waveguides and having lengths which vary according to a predetermined relationship to yield a desired plurality of phase shifts in response to the common applied voltage.

6. The apparatus of claim 5 wherein said plurality of electrodes have lengths which vary linearly.

7. The apparatus of claim 1 wherein the combining means includes a polarizing beam splitter.

8. The apparatus of claim 3 or 5 further comprising a second array of electrodes straddling said plurality of waveguides.

9. The apparatus of claim 4 or 7 wherein the polarizing axis of said combining means is oriented at substantially 45 degrees to the directions of polarizations of said light signals.

10. An apparatus for controlling beam steering of a two dimensional phased array having N rows and M columns of antenna elements comprising:

an electro-optic substrate;

at least N waveguides formed in said substrate, each of said at least N waveguides being capable of simultaneously propagating light signals with orthogonal polarizations;

an input waveguide for inputting into each one of said at least N waveguides a pair of co-propagating polarized light signals having orthogonal polarizations and offset frequencies;

a first plurality of electrodes on said substrate configured to phase shift the signals traveling through each of said at least N waveguides by a different amount in response to a first set of applied voltages, thereby creating a first set of phase shifted polarized signals;

at least (N×M) waveguides, each of said at least (N×M) waveguides being capable of simultaneously propagating light signals with orthogonal polarizations;

waveguide splitters formed in said substrate for splitting the first set of phase shifted polarized signals from said at least N waveguides into said at least (N×M) waveguides;

a second plurality of electrodes on said substrate configured to phase shift the signals traveling through each of said at least (N×M) waveguides by a different amount in response to a second set of applied voltages, thereby creating a second set of phase shifted polarized signals; and means for combining the phase shifted polarized signals within each one of said at least (N×M) waveguides and propagating said combined signals to an antenna element.

11. The apparatus of claim 1 or 10 further comprising means for adjusting the amplitude of said signals.

12. The apparatus of claim 10 wherein said first set of applied voltages include a plurality of voltages, each of which is applied to one of said first plurality of electrodes, substantially simultaneously.

13. The apparatus of claim 12 wherein said first plurality of electrodes includes a series of electrodes straddling said plurality of waveguides and having equal lengths.

14. The apparatus of claim 10 wherein said second set of applied voltages include a plurality of voltages, each of which is applied to one of said second plurality of electrodes, substantially simultaneously.

15. The apparatus of claim 14 wherein said second plurality of electrodes includes a series of electrodes straddling said plurality of waveguides and having equal lengths.

16. The apparatus of claim 10 wherein said waveguide splitters split said signals into said at least (N×M) waveguides, in N sets of M waveguides.

17. The apparatus of claim 16 wherein said first set of applied voltages include a voltage applied in common to each of said first plurality of electrodes.

18. The apparatus of claim 17 wherein said first plurality of electrodes includes a series of electrodes each of straddling said first plurality of waveguides and having lengths which vary according to a predetermined relationship to yield a desired plurality of phase shifts in response to the common applied voltage.

19. The apparatus of claim 18 wherein said first plurality of electrodes have lengths which vary linearly.

20. The apparatus of claim 16 wherein said second set of applied voltages include a voltage applied in common to each of said second plurality of electrodes.

21. The apparatus of claim 20 wherein said second plurality of electrodes includes a series of electrodes straddling each of said second plurality of waveguides and having lengths which vary according to a predetermined relationship to yield a desired plurality of phase shifts in response to the common applied voltage.

22. The apparatus of claim 21 wherein said second plurality of electrodes have lengths which vary linearly.

23. The apparatus of claim 11 wherein sais amplitude adjustment means compress an array of Mach-Zender interferometers.

* * * * *